US005607141A

United States Patent [19]

Clark

[11] Patent Number: 5,607,141

[45] Date of Patent: Mar. 4, 1997

[54] EXTENDABLE SUPPORT ARM FOR A CARPET STRETCHER

[76] Inventor: James F. Clark, Rte. 2, Box 19, Amity, Ark. 71921

[21] Appl. No.: 360,303

[22] Filed: Dec. 21, 1994

[51] Int. Cl.[6] ..... B66D 1/00

[52] U.S. Cl. ..... 254/200; 52/730.1; 403/377

[58] Field of Search ..... 403/376, 377, 403/378, 109, 363, 381; 52/117, 731.7, 731.8, 731.9, 730.1, 645, 646; 33/809; 254/209, 210, 206

[56] References Cited

U.S. PATENT DOCUMENTS

| | | | |
|---|---|---|---|
| 404,788 | 6/1889 | Kelly | 403/363 |
| 611,344 | 9/1898 | Wagner . | |
| 656,467 | 8/1900 | Miotke . | |
| 674,873 | 5/1901 | Ockschim . | |
| 717,829 | 1/1903 | Fehrmann . | |
| 782,094 | 2/1905 | Woodcock . | |
| 857,777 | 6/1907 | White . | |
| 943,199 | 12/1909 | Noll | 254/209 |
| 1,391,621 | 9/1921 | Fenwirth | 33/809 |
| 2,160,134 | 5/1939 | Fanning . | |
| 2,883,222 | 4/1959 | Sands | 403/363 |
| 2,938,743 | 5/1960 | Sproule | 403/363 |
| 3,094,787 | 6/1963 | Moore | 403/363 |
| 3,207,474 | 9/1965 | Silva . | |
| 3,738,690 | 6/1973 | White | 52/731.7 |
| 4,230,302 | 10/1980 | Crain, Jr. . | |
| 4,828,305 | 5/1989 | Gaddy | 254/209 |
| 4,934,658 | 6/1990 | Berg et al. . | |
| 5,079,884 | 1/1992 | Menchetti | 52/731.9 |
| 5,150,884 | 9/1992 | Hyer et al. | 254/209 |
| 5,183,238 | 2/1993 | Sorensen . | |

*Primary Examiner*—Katherine Matecki
*Attorney, Agent, or Firm*—Raymond L. Greene

[57] ABSTRACT

An extendable support arm for a carpet stretcher is provided. The extendable support arm is a multiple section telescoping arm having several telescoping sections made from angle aluminum extrusions. The angle extrusions all have the same cross-sectional shape and size thereby reducing manufacturing costs and allowing the changing of the total telescoping length by either removing or adding telescoping sections. Gravity-operated locks hold each section in the extended position, while a combination in gravity-actuated and manually-actuated locks allow fine adjustment of length on one of the telescoping sections. Turning the entire assembly over to the upside down position unlocks all sections allowing the arm to be collapsed. A tail block with casterable wheels is provided to allow easy movement of the stretcher within a room.

12 Claims, 4 Drawing Sheets

EXTENDABLE SUPPORT ARM FOR A CARPET STRETCHER

FIELD OF THE INVENTION

The invention is related to the carpet stretching field and in particular to adjustable support arms.

BACKGROUND OF THE INVENTION

Installation of carpet typically requires attachment of the carpet to a tack strip at one wall and then applying a stretching force to the opposite end of the carpet. Numerous devices have been developed during the past century to aid in carpet stretching. Two of the most common in use today include the Knee-Kicker device and the lever-operated hand stretcher supported by a telescoping tube. The Knee-Kicker device, while convenient for small areas and short runs of carpet, is physically demanding (and may also cause knee injury) and performs poorly for large rooms having long runs of carpet. The second type of stretcher, using a telescoping support with a hand-operated stretcher is aimed at avoiding the physical limitations of the Knee-Kicker. A typical telescoping support stretcher has a tubular assembly of concentric tubes, each inner tube being smaller than the preceding tube. Also typically, the tubes lock by a twist clamping device or snap-in device at the end of each telescoping section. This type of construction limits the usefulness of the extender. First, each telescoping section is a different diameter in order to allow one to fit inside the next. Although this size difference increases manufacturing and assembly costs, the main difficulty as noted by Sorensen, U.S. Pat. No. 5,183,238, is that at the desirable weights to match most carpeting jobs, the slender telescoping pole becomes too flexible for long stretches of carpet. This lack of strength and stability means that existing extendable supports are typically not adaptable to large installations. Likewise, the few heavy extendable supports are too heavy and unwieldy for the more usual smaller installations. No current art provides a stretcher support which has same-sized telescoping sections, and thereby equally strong sections, which may be used with more or fewer sections as necessary to match a particular job.

SUMMARY OF THE INVENTION

Accordingly, it is an object of the invention to provide an extendable support arm with improved stiffness and rigidity.

It is another object of the invention to provide an extendable support arm having self-actuating locking mechanisms.

It is still another object of the invention to provide an extendable support arm having multiple removal telescoping sections.

It is a further object of the invention to provide an extendable support arm having multiple same-sized telescoping sections.

In accordance with these objects, the invention is an extendable support arm for a carpet stretcher comprising a pivotable base block attached to an L-channel telescoping section having exterior bearing shoulders. Additionally, intermediate or center L-channel telescoping sections of the same size and shape are slideably attached to the base block channel. A fine-adjustment telescoping section is located between the center telescoping sections and the final telescoping section, the fine adjustment section has a plurality of beveled locking slots spaced at short intervals along its length. A final telescoping section has a manual locking mechanism and means for attaching a conventionally known carpet stretcher device. Each of the intermediate channels has a gravity operated lock which allows for position-locking and which provides for gravity unlocking or disengagement when the entire mechanism is turned over to the upside-down position. These locks are formed using pivoting latches which engage slots in the telescoping sections. These slots have two perpendicular (vertical) edges.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
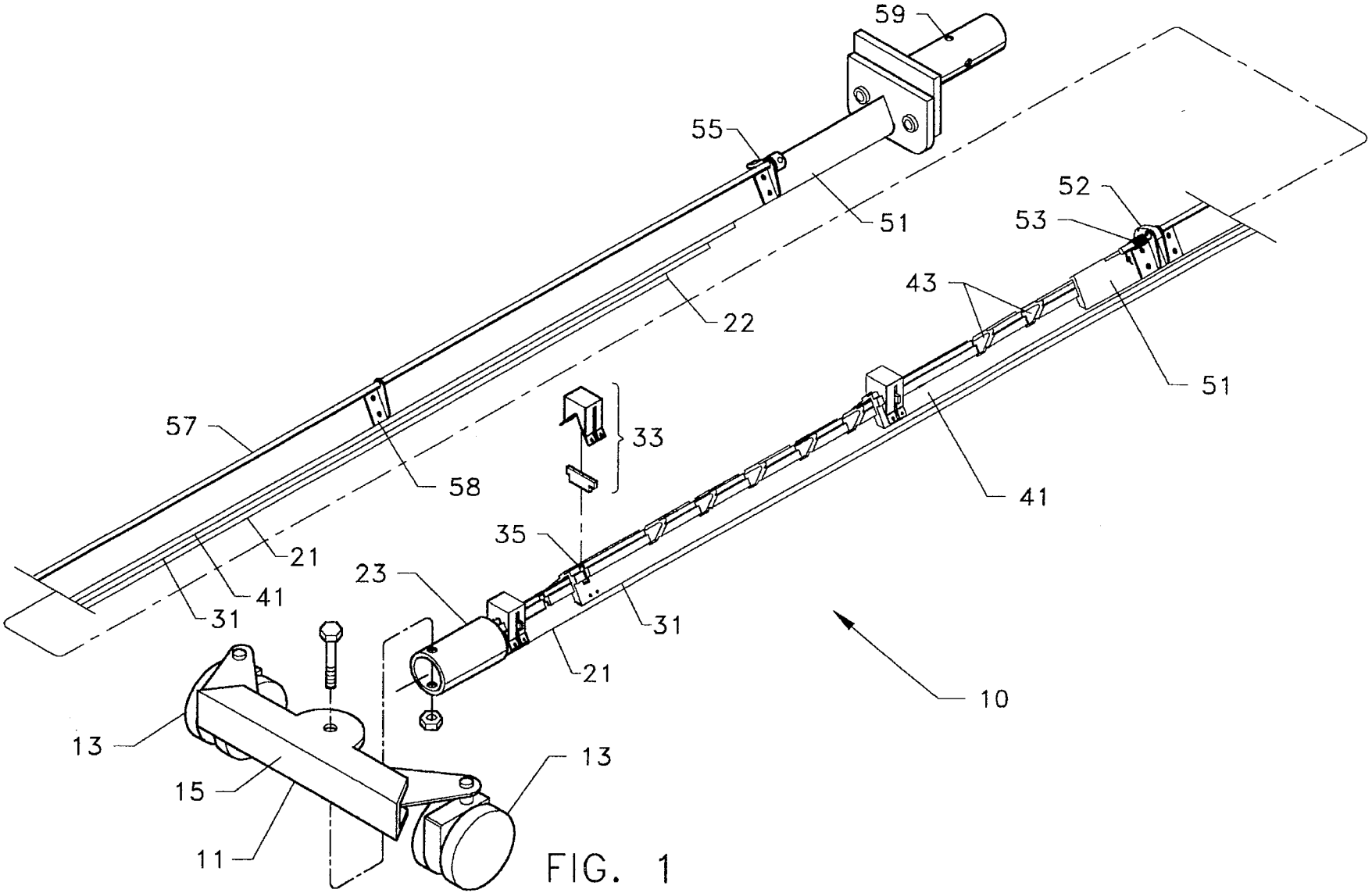
FIG. 1 is a perspective view of the extendable support arm.

Referring now to FIG. 1, the overall extendable support arm mechanism, designated generally by the reference numeral 10, is shown with its major components. A tail block 11 is pivotably attached to a first telescoping section 21 through a pivotable mounting collar 23 attached to a first end of the first telescoping section 21. The tail block 11 has castering wheels 13 attached to the ends of the tail block to allow easy movement in any direction. The wheels 13 are recessed away from the support surface 15 of tail block 11 so that the support surface will contact a supporting structure, such as a wall, without the wheels touching the structure.

As depicted in FIG. 1, the extendable arm mechanism is shown with a break in the drawing for the purpose of reducing the overall length of the drawing. The actual mechanism is one long continuous assembly. As shown, the first telescoping section 21 (reference numeral near the pivotable mounting collar) continues to extend in the upper portion of the drawing and is identified by a second labeling of the same reference number. Telescoping section 21 has, on a second end 22, a locking slot cut into the upper corner of the L-section (hidden in this view) approximately eight inches away from the second end. The telescoping section 21, and all other telescoping sections, are extruded aluminum sections, formed as angle arms, that is, having an L-shaped cross-section. Each telescoping section is the same cross-sectional shape and size.

As configured in FIG. 1, the extendable support arm 10 has one center telescoping section 31 and a fine-adjustment telescoping section 41. The center telescoping section 31 has a gravity-actuated locking mechanism 33 attached to a first end 35 and has a locking slot at the second end (away from the tail block) which is also not shown in this view. Because the telescoping sections are all identical in cross-section, more center sections can be added, thereby providing increased lengths for the entire mechanism.

The fine-adjustment telescoping section 41 is also identical to the previous sections, but has additional beveled locking slots 43 spaced along its upper edge. Whereas, the previous telescoping sections can only lock in place when fully extended, the fine-adjustment telescoping section 41 allows the final telescoping section 51 to be locked all along its length at intervals of approximately two inches.

The final telescoping section 51 has a gravity-actuated and manual-disengageable locking mechanism operating latch 52 attached at its first end. This latch engages the beveled locking slots 43 and can be manually disengaged by depressing lever 55 which turns rod 57, attached by brackets 58, thereby lifting the latch out of the locking slots, this entire assembly comprises the manually disengageable locking mechanism. On the second end of the final telescoping section is a mounting assembly 59 for attaching a conventional hand-lever type carpet stretcher head.

Figure 2:
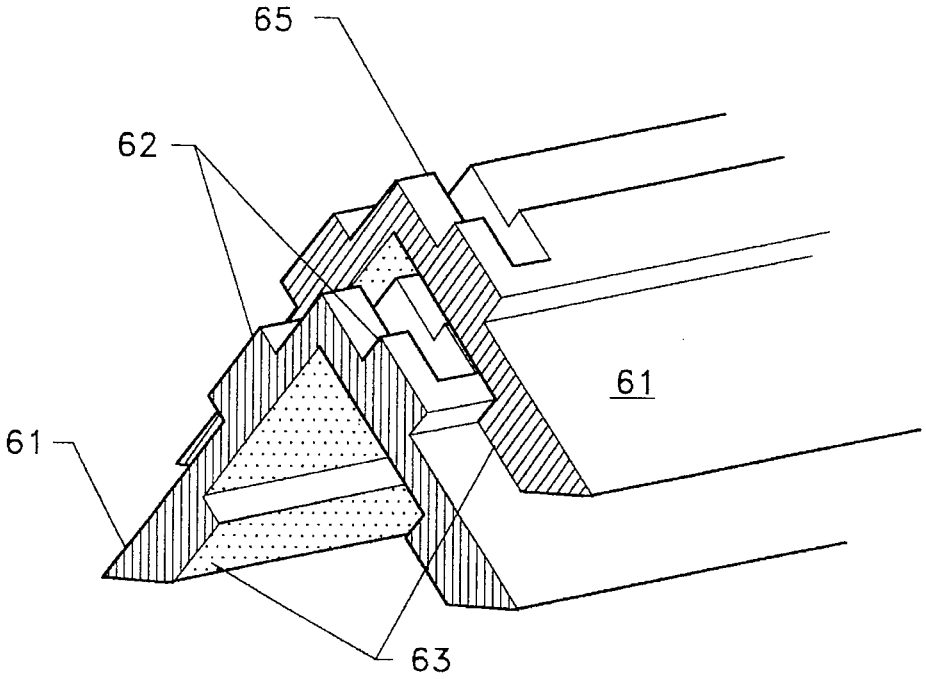
FIG. 2 is a partial perspective view of the telescoping sections.

A more detailed view of the telescoping sections may be seen in FIG. 2. The end sections 61 of two representative telescoping sections shown in this figure depict the identical cross-sectional shape and size of the telescoping sections. Each section has a raised sliding surface 62 and raised interlocking surface 63. The sliding surface 62 is sufficiently smooth as extruded to provide a non-galling sliding surface as is the adjacent surface of the adjoining telescoping section. The interlocking surfaces 63 overlap sliding surfaces 62 so as to prevent separation of the telescoping sections. Additionally, each telescoping section has a locking slots 65 and threaded bore holes for attachment of the locking mechanism.

Figure 3:
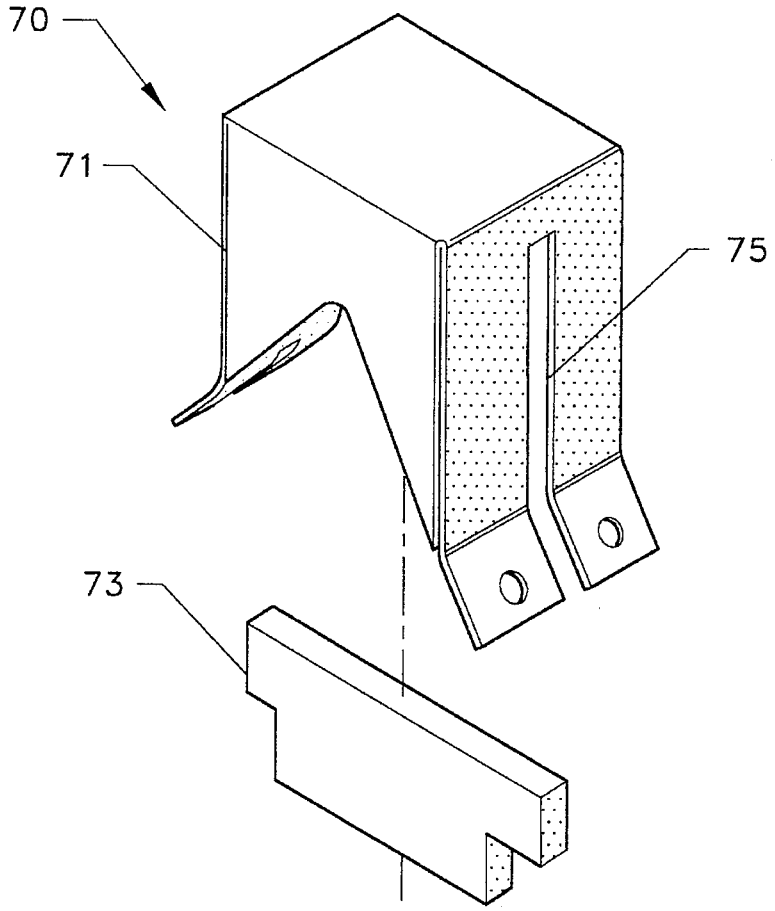
FIG. 3 is a perspective view of the gravity-locking mechanism.

The gravity-actuated locking mechanism 70 in FIG. 3 comprises two components, a housing 71 and a gravity-actuated latch 73. Latch 73 slides up and down in slot 75. When installed on a telescoping section the latch also slides into the locking slot 65.

Figure 4A:
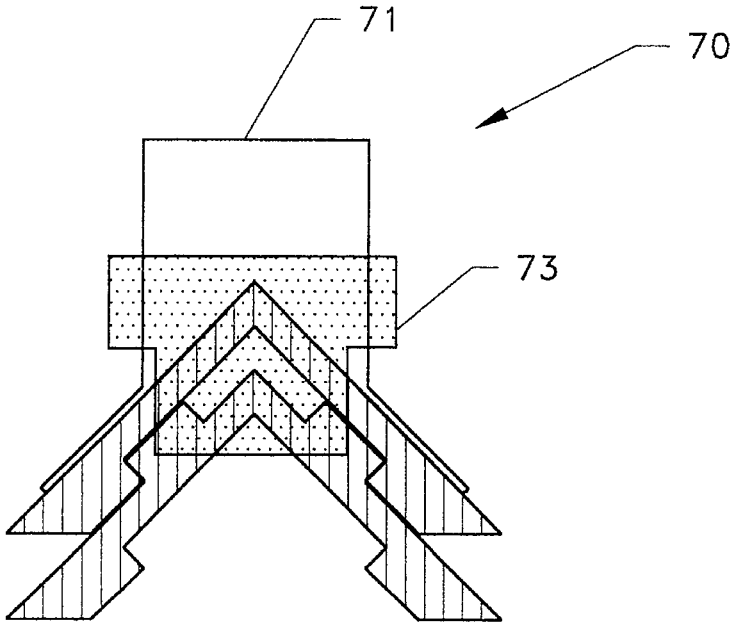
FIG. 4*a* is a cross-sectional view showing the engagement of the gravity-locking mechanism.
Figure 4B:
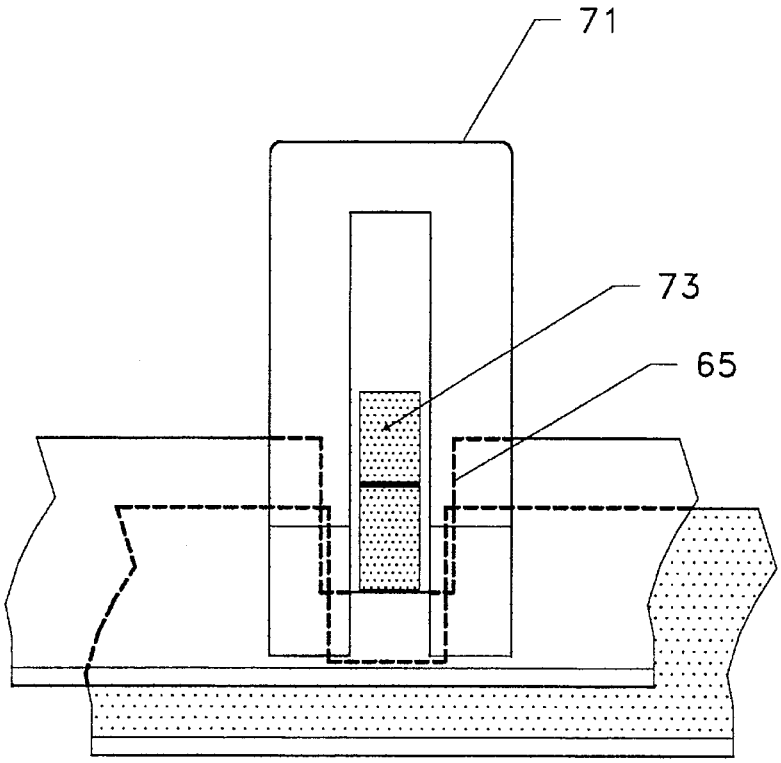
FIG. 4*b* is a side view of the locked gravity-locking mechanism.

The operation of the gravity-actuated locking mechanism 70 may be seen during the locking operation in FIGS. 4*a* and 4*b*. With the telescoping sections, in the upright position, latch 73 slides downward in housing 71 engaging both the upper and lower telescoping sections. FIG. 4*b* shows a side view with latch 73 in the locked position in the lower portion of the housing 71 and extending into slots 65 on both telescoping sections. When a force is applied to the support arm-during carpet stretching, the latch transfers the load directly from one telescoping section to the next. No forces are applied to the locking mechanism housing 71.

Figure 5B:
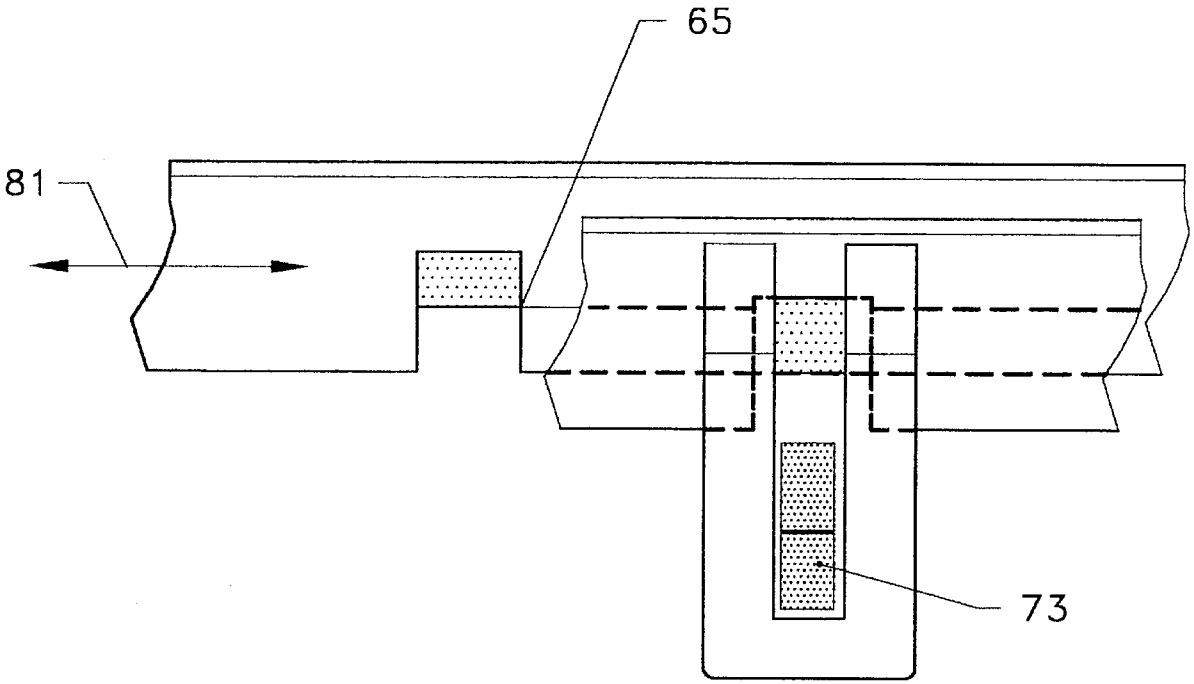
FIG. 5*b* is a side view of the unlocked gravity-locking mechanism.
Figure 5A:
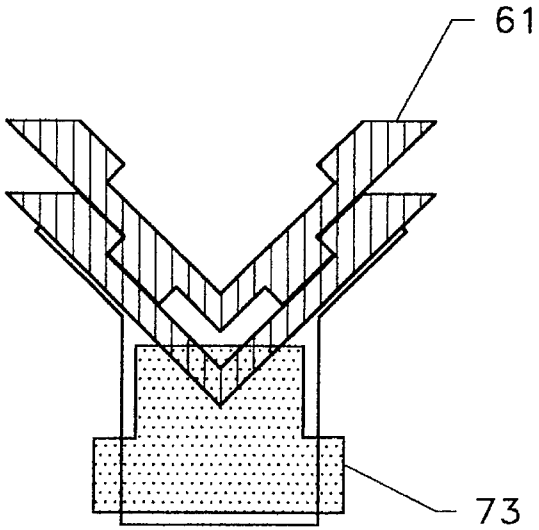
FIG. 5*a* is a cross-sectional view showing the disengagement of the gravity-locking mechanism.

Unlocking the gravity-actuated locking mechanism is accomplished by rotating the extendable support arm assembly to the inverted position as shown in FIGS. 5*a* and 5*b*. In this position, latch 73 drops out of the slot in the now uppermost telescoping section 61 (as shown in FIG. 2). Referring to FIG. 5*b*, latch 73 is clear of slot 65 and allows extension or retraction as depicted by arrow 81.

Although all locks on the extendable arm are gravity-actuated, the lock on the final telescoping section also can be manually held in the unlatched position. Referring back to FIG. 1, latch 52 is also a floating latch which is gravity-actuated. As in the other latch mechanism, latch 52 engages in the upright position and disengages in the inverted position. However, latch 52 may also be disengaged in the upright position by depressing lever 55 and thereby rotating rod 57 which in turn rotates latch 52 upward disengaging the lock. This manual unlocking allows the carpet installer to re-position the stretcher head without releasing all other locks and without turning the entire arm upside down. Coil spring 53 holds the rod and lever assembly in the locked position (however latch 52 can still be rotated by gravity to the unlatched position).

The advantages and features of the invention are numerous. The extendable arm is fabricated of identically-sized extrusions providing three benefits. First, manufacturing costs are reduced; second, the number of center sections can be increased or decreased as necessary; and, third, there is no smaller and therefore weaker telescoping sections as in the conventional concentric tube arrangement. The same-sized telescoping sections thereby avoid one of the problems of the prior art which is a lack of rigidity for long extensions.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. An extendable support for a carpet stretcher comprising:

means for supporting an extendable arm;

an extendable arm, attached to said means for supporting, having a plurality of telescoping sections each having an L-shaped cross-section and each having the same cross-sectional size each of the telescoping sections having means for interlocking with other telescoping section and preventing separation of the telescoping sections from each other in a direction transverse to their length;

means for locking said telescoping sections in various extended positions; and means for attaching a carpet stretcher head to said extendable arm.

2. An extendable support as in claim 1 wherein said means for supporting comprises a pivotable-mounted tail block.

3. An extendable support as in claim 2 wherein said pivotable-mounted tail block has castering wheels attached thereto.

4. An extendable support as in claim 1 wherein said extendable arm further comprises a first telescoping L-shaped section having, on a first end, a pivotable mount for attaching to said means for support, and on a second end, a locking slot for locking said first telescoping section to another telescoping section when extended.

5. An extendable support as in claim 4 wherein said extendable arm further comprises a plurality of center L-shaped telescoping sections, each having a first locking slot on a first end for locking to a preceding section and a second locking slot on a second end for locking to a following section.

6. An extendable support as in claim 5 wherein said means for locking comprises a gravity-actuated latch attached to the first ends of each center telescoping section.

7. An extendable support as in claim 1 wherein said extendable arm further comprises a fine-adjustment telescoping section having a locking slot on a first end and a plurality of beveled locking slots equally spaced and extending along the length of said fine-adjustment telescoping section.

8. An extendable support as in claim 7 wherein said means for locking further comprises a first end of the fine adjustment telescoping section.

9. An extendable support as in claim 1 wherein said extendable arm further comprises a final telescoping section having a locking slot and mounting means for a manually-disengageable locking mechanism, said manually-disengageable locking mechanism being operable from an operations position at a stretcher head.

10. An extendable support as in claim 9 wherein said mounting means comprises a plurality of brackets attached along the length of said final telescoping section, each bracket having a bore hole for receiving an operating rod.

11. An extendable support as in claim 9 wherein said means for locking further comprises a combination gravity-actuated and manually disengageable locking mechanism.

12. An extendable support as in claim 11 wherein said means for locking further comprises a rod attached to said gravity-actuated and manually-disengageable latch, said rod attached to said final telescoping section by a plurality of brackets and having a lever attached to said rod on the end opposite the latch.

* * * * *